United States Patent [19]

Hynes

[11] Patent Number: 4,527,482

[45] Date of Patent: Jul. 9, 1985

[54] BLASTING CAP TO PRIMER ADAPTER

[76] Inventor: Frederick B. W. Hynes, 8778 E. Thunderbird Ct., Parker, Colo. 80134

[21] Appl. No.: 314,479

[22] Filed: Oct. 23, 1981

[51] Int. Cl.[3] ..... F42D 1/08; F42B 3/10; C06C 5/04

[52] U.S. Cl. ..... 102/331; 102/313; 102/318; 102/275.2; 102/275.5; 102/275.7; 86/20 C

[58] Field of Search ..... 102/304, 312, 313, 315, 102/316, 318, 320, 321, 322, 331, 275.2, 275.3, 275.4, 275.5, 275.6, 275.7; 86/20 C

[56] References Cited

U.S. PATENT DOCUMENTS

| | | | |
|---|---|---|---|
| 2,449,511 | 9/1948 | Russell | 102/331 X |
| 3,455,242 | 7/1969 | Slawinski | 102/275.5 X |
| 3,783,789 | 1/1974 | Rose | 102/322 X |
| 3,793,954 | 2/1974 | Johnston | 102/275.5 X |
| 4,037,536 | 7/1977 | Griffith | 102/331 |
| 4,060,033 | 11/1977 | Postupack et al. | 102/318 |
| 4,141,296 | 2/1979 | Calder et al. | 102/318 X |
| 4,165,691 | 8/1979 | Bowman et al. | 102/275.7 X |
| 4,282,812 | 8/1981 | Forgey et al. | 102/318 |
| 4,350,097 | 9/1982 | Bowman et al. | 102/275.2 |
| 4,383,484 | 5/1983 | Morrey | 102/322 |

*Primary Examiner*—David H. Brown
*Attorney, Agent, or Firm*—Harvey B. Jacobson

[57] ABSTRACT

A blasting cap to primer adapter permits the use of any size of a blasting cap and associated shock tube in combination with commercially available primers and detonating cords. In one embodiment, a bracket arrangement and cord tunnel assembly having a plurality of tunnels is employed attachable to a primer having a tunnel through which an associated blasting cap shock tube may be looped, while a length of detonating cord may be similarly directed through the tunnel assembly of the adapter. An ignition of the detonating cord will result in a concurrent ignition of the shock tube to effect the desired explosion of the primer. Through this construction, any number of primers and blasting cap arrangements can be attached to and ignited by a single detonating cord. Other embodiments of the invention are directed strictly to cord tunnels in adapters which dispense with a retaining bracket, such tunnel adapters being retained in position against a primer by the interweaving of an associated shock tube through the adapter and primer tunnels, with the blasting cap being retained in the available cap well on the primer. A final embodiment envisions an integral construction which includes the cord tunnel adapters being manufactured in an attached relationship to the primers, while the detonating cord may be constructed in the form of a pigtail which is in direct communication with the explosive contained in the interior of the primer.

3 Claims, 28 Drawing Figures

PRIOR ART

Fig. 25
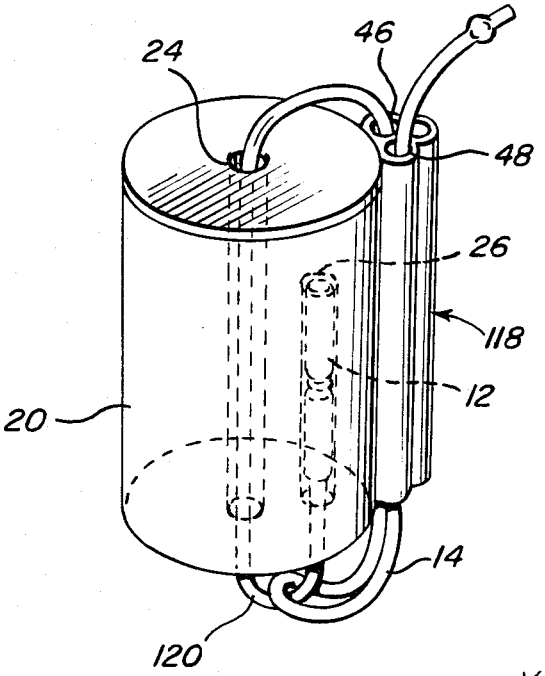
Fig. 26
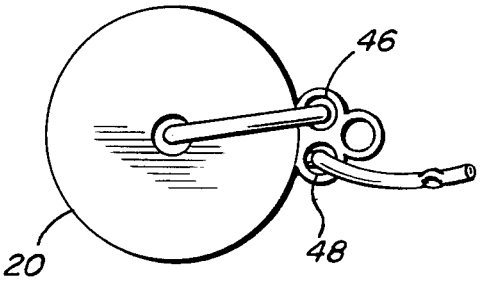
Fig. 27
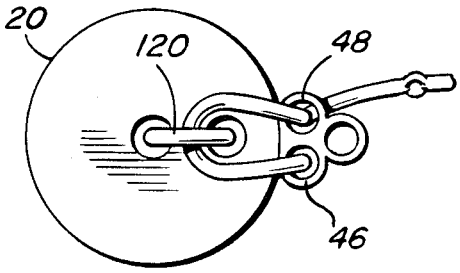
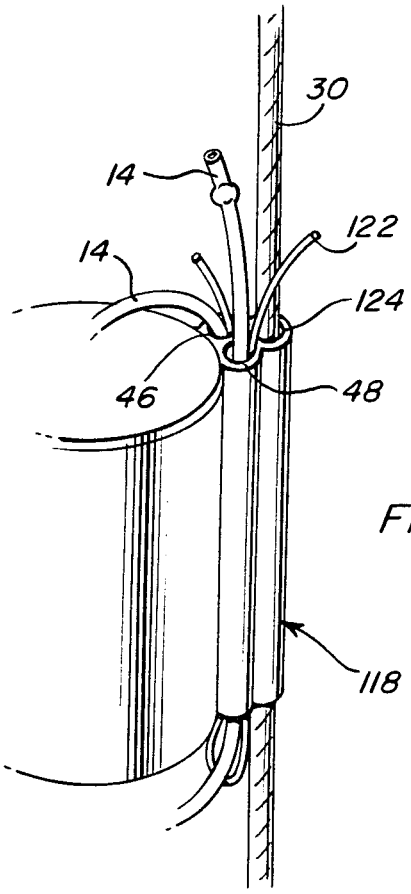
Fig. 28

BLASTING CAP TO PRIMER ADAPTER

BACKGROUND OF THE INVENTION

1. Field of the Invention

The present invention generally relates to an adapter for interconnecting at least one of a plurality of types of blasting caps and primers so as to provide delayed ignition of the primers while utilizing a single detonating cord within a blast hole to accomplish the multiple ignitions. More particularly, the invention relates to an arrangement that provides for a shock tube element as a component for attaching a primer to an adapter.

2. Description of the Prior Art

Modern mining, quarrying and construction excavation requires the use of explosives in such large quantities in single bore holes as to cause annoying vibration to people and actual damage to structures. To prevent this annoyance and damage, and to comply with Federal Regulations, a single explosive charge must sometimes be divided into two or more charges detonated at substantially different instants of time, each charge in a bore hole being separated from next-in-line charges by inert material, usually small sized rock particles. The appropriate delay times between the segmented charges is a matter of debate and choice, and in general these delays are between 8 and 25 milliseconds. As such, in an extreme but realistic situation wherein there may be eight individual explosive charges in a single bore hole (these charges being commonly referred to as decks or deck charges), there may be a total elapsed time from the first deck detonation to the last detonation of 175 milliseconds. Until recently, the only practical way to achieve an in-hole delay was to use individually delayed electric or non-electric blasting caps in a suitable primer, the primer being appropriately imbedded in or in contact with the explosive of each deck.

All explosives used today for surface mining are insensitive compared to previously used nitroglycerin explosives, such as dynamite Insensitive explosives will not detonate from an impact of a hard object, such as a steel shovel bucket, whereas nitroglycerin explosives will so detonate. These less sensitive explosives are commonly referred to as blasting agents, such blasting agents being generally understood to be any explosive mixture which cannot be detonated unconfined by a number 8 test cap. Most of the insensitive explosives utilize ammonium nitrate as the principal explosive ingredient. In dry form, the ammonium nitrate is generally mixed with 5% to 6% of fuel oil and is commonly referred to as ANFO. Additionally, there are methods of combining the ammonium nitrate with water and other ingredients to produce a waterproof explosive. Inasmuch as ANFO is not waterproof, the waterproof mixes per se are referred to as slurries or emulsions, depending on the ingredients used and the manufacturer's pleasure. Sensitivity of explosives currently in use range from dynamites to blasting agents, dynamites being readily initiated by detonating cords or caps and blasting agents generally requiring a primer which is initiated by a cord or cap.

In effect, almost none of the currently used explosives can be detonated by a blasting cap and as such, these explosives when used in surface blasting must be detonated by a primer. A primer is generally understood to be a package of explosive into which has been inserted a cap or to which has been attached a detonating cord. The cap or cord then detonates the primer, and the primer in its turn detonates the explosive with which it is in contact.

Primers can be packages of dynamite, cast primers or slurry primers. Dynamite primers are not generally used in holes having diameters of six inches or more, while it is commonly used in four inch and smaller holes. Cast primers are made from different mixtures of pentalite, which is a generic term referring to the ingredients which can vary in composition. However, at ordinary temperatures, pentalite is a solid, very insensitive explosive which is quite powerful when detonated. Slurry primers are simply a more sensitive composition of slurries contained in either a flexible or near rigid container.

All rigid or semi-rigid primers, such as cast primers or slurry primers, contained within a shell of hard or stiff plastic, as opposed to a flexible plastic film, have preformed holes within the body of the primer per se and shell to accept detonating cords or caps, or both. As above mentioned, cast primers and slurry primers are caused to detonate either by a blasting cap or a detonating cord, and the blasting caps may be of either an electric or non-electric actuated construction. Electric blasting caps are manufactured by several companies and have the same general appearance and operating characteristics. Non-electric blasting caps are made by several different companies, but they are not similar in operating principle. However, all caps are themselves similar in appearance, i.e., a rigid metal shell which can be inserted into a receptacle called a cap well contained within the primer.

In addition to a cap well, primers always have a hole or cord tunnel parallel to the axis of the primer, and generally coinciding with the axis, through which detonating cord may be passed. Alternatively, a primer may be provided with two cord tunnels passing completely through the primer, as opposed to a cord tunnel and a cap well. If the primer is to be initiated by a detonating cord, the cord or cords are passed through the tunnel or tunnels, with the primers per se being threaded into the cord(s). If a cap is used, the cap is inserted into the cap well, the lead to the cap having been first passed through the tunnel, or, in the case of certain kinds of non-electric caps, the lead may be taped to the outside of the primer.

Detonating cord has a burn velocity of 18,000 to 22,000 feet per second, so when more than one primer is threaded onto the same piece of detonating cord, as they would be in a single blast hole, all of the primers detonate at essentially the same instant. For example, a blast hole 100 feet deep with six primers 12 feet apart located from the bottom of the hole upwardly, would see the top primer detonated first while the bottom primer being located 72 feet below it would detonate 0.0036 seconds later.

The advantage of blasting caps is that different delays can be used in these multiple primer arrangements. The disadvantage is that each cap must have a separate lead, meaning that for six delays, there would be six electric blasting cap wires coming out of the hole, or in the case of non-electric delays, six different non-electric leads.

Certain cast primer manufacturers have designed primers which house specially arranged delay cap assemblies. The primers can be threaded onto a detonating cord and allowed to slide down the cord as desired, eventually coming to rest in a blast hole at a predetermined depth. When the cord detonates, it activates the delay cap, which in turn detonates the primer after a predetermined delay. Thus, there only needs to be one cord coming out of the hole and it can accommodate any number of delay primers. In this respect, at least two of the manufacturers are the Austin Powder Company and the Atlas Powder Company. The delay primers manufactured by both of these companies incorporate specific proprietary delays which cannot and are not used in any other way for any other purpose. The use of either requires two parts, i.e., the primer which is designed for the cap and the cap which is designed for the primer. These specially designed primers and caps are not interchangeable, nor can any part be used for any other purpose independently therefrom.

Several patents describing assemblies of delay caps with primers (the term "primer" as used hereinafter refers to any primer other than dynamite) are: U.S. Pat. Nos. 3,590,739, 3,125,024, 3,987,733, 4,023,494, 4,037,536, 4,060,033, 4,165,691, 4,178,852, and 4,141,296. These patents showing a specific primer body and a specific delay cap element whereby each primer body and cap element is used solely with each other, whether taken and viewed throughout singly or in combination with each other, are believed to have no bearing on the patentability of any claim of the invention.

As such, there can be seen to exist a need for a means of joining any type and design of primer to any type and design of blasting cap. In this respect, the present invention substantially fulfills this need.

Effectively, the present invention provides means of assembling in the field and at the point of use commonly used and everywhere available non-electric delay caps, such as the HD Nonel Primadet and the Primaline Primadet (both manufactured by the Ensign Bickford Company, of Simsbury, Conn.) and any primer containing a cap well and cord tunnel, such primers being made by several companies including, but not limited to, the Trojan Powder Co., Ireco Chemicals Co., Gulf Chemicals Division, Austin Powder Co., and Sierra Chemicals Co. Specifically, until the presentation of the present invention, there has been no way to join primers made by any one of these companies to any non-electric delay cap, so as to permit detonation in multiple, delayed units in a single bore hole from a single line of detonating cord. Therefore, to achieve multiple delays in a single bore hole with any of these standard primers has always required separate leads to each cap, regardless of whether the cap is of an electric or non-electric construction.

SUMMARY OF THE INVENTION

The general purpose of the present invention, which will be described subsequently in greater detail, is to provide adapters for connecting any design and construction of primer to any design and construction of blasting cap from any design of detonating cord and that has all of the advantages of the prior art adapters and none of the disadvantages. In this connection, the present invention is directed to adapters which will join any primer now on the market, excepting the above described two specially designed delay primers, with the most commonly used non-electric delay blasting caps presently used for blast hole delay, i.e., Ensign Bickford's HD Nonel Primadet and Primaline Primadet. In this regard, it is to be understood that all reference to "Nonel" in this specification applies equally well to the HD Nonel Primadets, (1) Primaline Primadets and (2) regular Nonel Primadets, as well as to HD Nonel and regular Nonel tubing or leads associated respectively therewith. These blasting caps are designed to be tied to an end of a detonating cord, which means that normally one cord is required for each delay, and whereas the present invention permits any number of delays determined by use of any of several blasting caps connected on the same single detonating cord. Additionally, the present invention can be used with any detonating cord on the market, including the smallest one called HD Primaline ($7\frac{1}{2}$ grains/foot of PETN) made by Ensign Bickford and intended for use with the HD and regular Nonel. The other two specially designed delay primers will not presently function with this small cord. At the same time, it is a well known fact that detonating cords adversely affect insensitive explosives, such an ANFO and slurries, and the smaller the cord used, the better the energy developed by the explosive. Hence, being able to use the small cord is a distinct advantage.

Further, the embodiments described herein are much less expensive and simpler to use than any of the previously patented delay primers, as neither the HD Nonel Primadet and regular Nonel Primadet, nor the primer needs to be pre-matched by the manufacturer. In this regard, all explosive retailers sell one or more kinds and types of cast primers and all have available for re-sale both the HD Nonel Primadet and Primaline Primadet, thus making the procurement of a less expensive and simplier delay primer readily available to any user.

Further still, the invention described herein will function with any detonating cord available, whereas each of the patented devices requires a specific matching of the detonating cord to the particular primer. Effectively, the present invention will function with any cord from the largest used, which may be 60-grains of PETN per foot, down to as low as 7-grains per foot. Specifically, both the HD Nonel Primadet and the Primaline Primadet are intended to be tied to an end of a detonating cord line and lowered into position in a bore hole. Detonating cords generally used for this purpose are from approximately $7\frac{1}{2}$-grains to 60-grains, while the more commonly used ones are $7\frac{1}{2}$, 20 and 25-grains. In this respect, detonating cords are classified most commonly by the number of grains of PETN per foot of length contained within the core of the cord, with more grains per foot resulting in increased intensity of detonation. Normally if more than one Primadet is used, each must be attached to its own line of detonating cord, while the present invention foresees the first primer into the hole being assembled to the Primadet and then attached to the cord of selected length in the usual manner, with the primer then being lowered into position, thus anchoring the bottom end of the cord which is commonly referred to in this condition as a "downline".

Thus, the first primer is delayed as desired in the blast hole at a minimum cost to the user, as contrasted to the more expensive previously referred to patented designs. Subsequent delayed primers supported by adapters will then be threaded onto the downline by the use of the present invention, as hereinafter described. Continuing then, both of the Nonel Primadets consist of a delay blasting cap attached to a shock tube called a Nonel tube. The Nonel tube is a hollow, flexible, plastic tube coated on the inside with an explosive. When this explosive coating is caused to ignite by a near adjacent explosion of any high explosive, such as a cap or a detonating cord, the internal explosive of the tube flashes along the inside of the tube but does not burst the side wall thereof. This flash ignites the delay element of the cap causing the cap to function as designed.

As will be subsequently noted, the present invention describes several means for providing a sliding adapter which will join any primer to any cord. A first means depends only on the Nonel tube of the Primadet. This tube is specifically designed for tensile strength and robust carcass strength so as to withstand any abuse which might be encountered in loading deep, ragged bore holes of any diameters. In this respect, some of these holes may be as large as 18 inches in diameter and frequently over 100 feet deep, while perhaps being more commonly only 10 inches in diameter and less than 100 feet in depth. The tube is laced at least one time through the system and may include once through the primer and twice through the three tunnel adapter forming the present invention, with the blasting cap then being inserted into the cap well. By pulling firmly on the outer end of the Primadet tube, the adapter is brought firmly up against the body of the primer without causing kinks in the tube. The outer end of the tube is then secured against slipping and loosening of the assembly by sliding a tube-lock down the tube and into the adapter tunnel where the lock is forced sufficiently into the adapter tunnel to secure the tube.

A second means of joining a Primadet to any primer includes a bridging arrangement to cause a separation of the adapter from the primer, thereby permitting the use of very powerful detonating cords which might otherwise destroy or initiate the primer. The arrangement may consist of two identical bridging pieces which force fit onto the extruded three tunnel adapter, or it may consist of two injection or extrusion molded pieces, one of which includes a bottom bridge and adapter tunnels and the other of which is force fitted to the tunnel. In both designs, the bridging piece includes short tubes or anchors which are inserted into the cord tunnel of the primer, thus establishing a fixed offset distance between the primer and the adapter tunnels. The entire assembly is then secured by lacing the Primadet tube through the primer and the adapter exactly as in the preceding description relative to the other adapter.

The tunnels in the adapter are fundamental to the concept as they permit lap joint initiation of the tube by the cord, yet permit a sliding fit of the cord to the adapter. Further, the two tunnels adjacent to the primer provide a separation and cushion which prevents the cord from damaging the primer. If any of the larger cords, and even in some cases the smallest of cords, are permitted to lie parallel to the axis of a primer and in contact with the side wall thereof, the cord can split or otherwise damage the primer causing a possible failure. Additionally, the three adapter tunnels permit the use of any size detonating cord for initiation of the Nonel tube of the Primadet.

The tunnels in the adapter are sized to permit direct or indirect initiation of the Nonel tube by a detonating cord. The Nonel tube and the smallest available cord will fit slidably within one tunnel. Larger cords must be threaded through adjacent tunnels. The smallest cord in a tunnel adjacent to a tunnel containing the Nonel tube will not initiate the Nonel tube; however, the two together in the same tunnel will cause initiation of the Nonel from the cord. In this connection, cords of 18, 20, 25, 30 and larger grain loads threaded through a tunnel adjacent to the tunnel containing the Nonel tube will initiate the tube. These relationships have been proven underwater and in dry conditions. With this unique flexibility, the user does not need to determine in advance which cord he must use as is required with other sliding delay primers. To the contrary, at the point of use, the user merely assembles the adapter to suit the cord at hand. The invention therefore proposes to provide in the apparatus of the prior art some features as a result of which the proper advantages will be retained and improved, whilst bringing thereto remedies for the inconveniences indicated above.

It is therefore an object of the present invention to provide an improved primer to blasting cap adapter that has all the advantages of similarly employed prior art primer to blasting cap adapters and none of the disadvantages.

It is another object of the present invention to provide an improved primer to blasting cap adapter which may be easily and economically manufactured.

It is a further object of the present invention to provide an improved primer to blasting cap adapter which is both simple in construction and limited in the number of moving parts.

Still another object of the present invention is to provide an improved primer to blasting cap adapter which is efficient and reliable in its operation.

Even another object of the present invention is to provide an improved primer to blasting cap adapter which is rugged and durable in its construction.

A still further object of the present invention is to provide an improved primer to blasting cap adapter which is simple to use.

An even further object of the present invention is to provide an improved primer to blasting cap adapter which will function with any type and size of detonating cord.

Yet still another object of the present invention is to provide an improved primer to blasting cap adapter which does not require a user to determine in advance which detonating cord must be used.

Still even another object of the present invention is to provide an improved primer to blasting cap adapter which permits the use of a plurality of delayed primer actuations while only requiring a single detonating cord to accomplish the same.

Further yet another object of the present invention is to provide an improved primer to blasting cap adapter which will join commonly available products in such a manner that they can be used in an entirely different manner and for an entirely different purpose than was formerly possible.

Yet even another object of the present invention is to provide an improved primer to blasting cap adapter which may be manufactured by an extrusion process.

Even still another object of the present invention is to provide an improved primer to blasting cap adapter which may be manufactured by injection molding.

Still yet further another object of the present invention is to provide an improved primer to blasting cap adapter which permits the use of an HD Nonel Primadet in combination with a primer to provide multiple delayed initiation of more than one primer while utilizing a single line of detonating cord in a blast hole.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 25 is a perspective view of the present invention illustrating a preferred method of interconnecting a blasting cap shock tube therewith.

FIG. 26 is a top plan view of the invention as illustrated in FIG. 25.

FIG. 27 is a bottom plan view of the invention as illustrated in FIG. 25.

FIG. 28 is a detailed perspective view illustrating the use of different sized tunnels in an adapter, as well as the use of a length of booster cord in association therewith.

DESCRIPTION OF THE PREFERRED EMBODIMENTS

Figure 1:
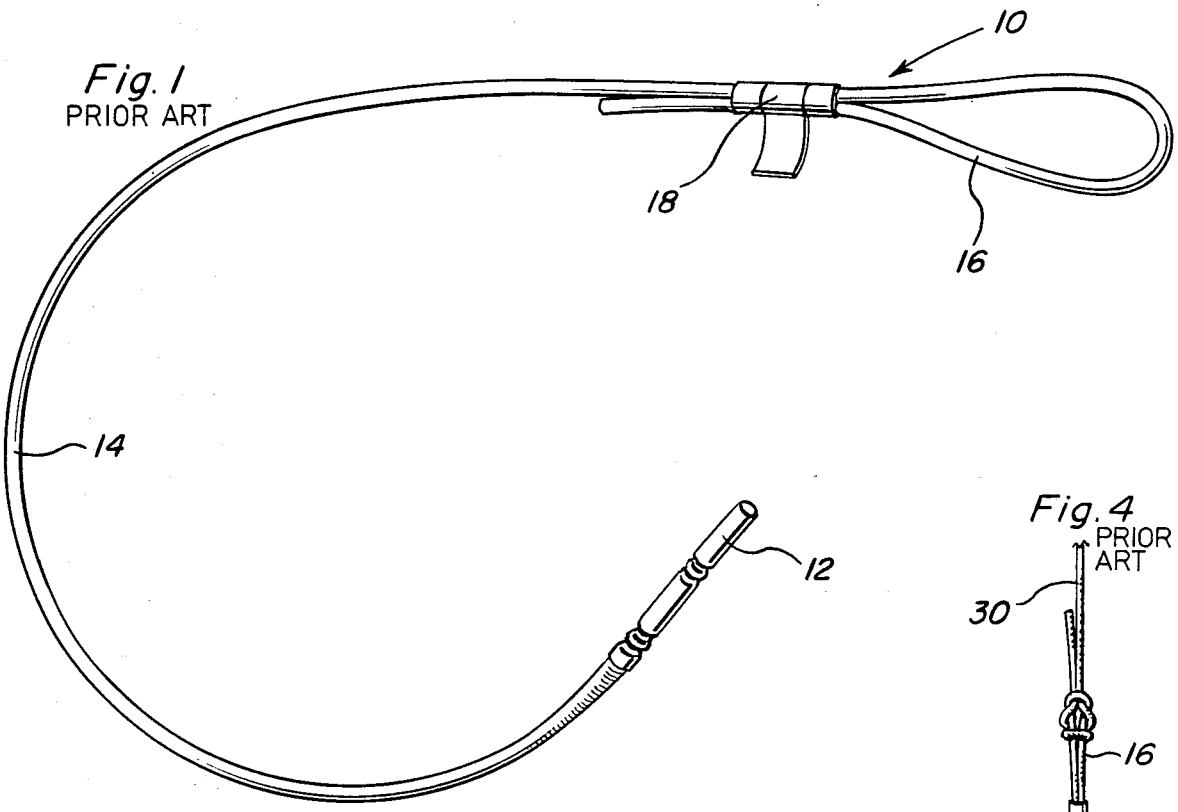
Fig. 1 PRIOR ART
FIG. 1 is a perspective view of a commercially available non-electric delay blasting cap and hollow plastic tube with a coated explosive mixture of the prior art.

With reference now to the drawings, several different blasting cap to primer adapters embodying the principles and concepts of the present invention will be discussed. In this respect, reference is first made to FIG. 1 of the drawings wherein a commercially available non-electric delay cap 10 is illustrated, such cap including a blasting cap 12 operably attached to a fuse portion 14 having a loop 16 on an end thereof. In this respect, the delay cap 10 is of the type commonly used in non-electric delay blasting systems for coal strips, quarries, open pit mines, and certain other underground operations requiring the use of explosives. In the context of the present invention, it is expected that the delay cap 10 would either consist of a commercially available HD Nonel Primadet or a regular Nonel Primadet wherein the fuse portion 14 consists of a 30 inch length of Nonel shock tube crimped to the blasting cap 12. In this respect, the fuse portion or Nonel shock tube 14 is a hollow plastic tube with a very small amount of reactive material coating an inside wall which propagates a noiseless shock wave signal at 6,000 feet per second or will flash through in 0.00042 seconds. The Nonel shock tube 14 is completely non-electric and is immune to initiation from flame and impact. As shown, the loop 16 is formed by the use of crimping material 18 and is operable to permit an efficient and effective attachment of the shock tube 14 to a detonating cord.

Figure 2:
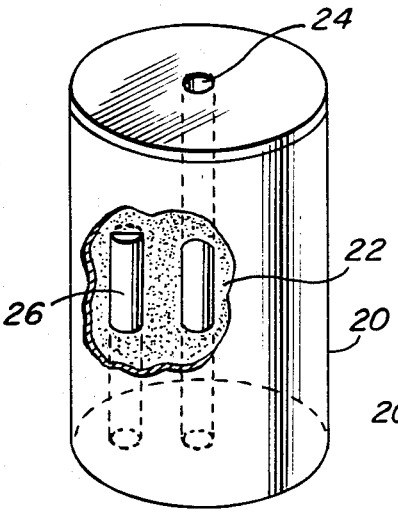
FIG. 2 is a perspective view of a prior art primer having a detonating cord tunnel and cap well.
Figure 3:
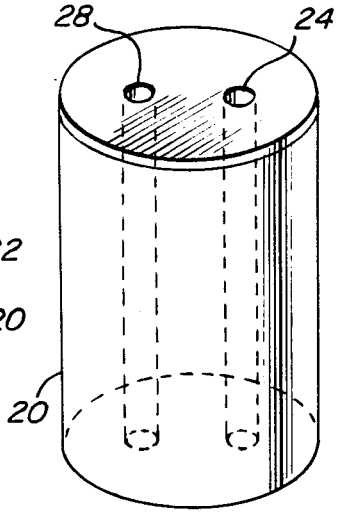
PRIOR ART Fig. 3
FIG. 3 is a perspective view of a primer of the prior art having two detonating cord tunnels.

FIGS. 2 and 3 illustrate conventional and commercially available primers for use in combination with the adapter of the present invention and with the delay cap 10 illustrated in FIG. 1 Specifically, FIG. 2 illustrates a slurry or cast primer 20 having an explosive 22 contained therein, and further including a through extending detonating cord tunnel 24. In this respect, a typical primer 20 is of a cylindrical construction and has at least one detonating cord tunnel 24 extending therethrough in parallel alignment with its longitudinal axis. Additionally, the embodiment of the primer 20 illustrated in FIG. 2 includes a cap well 26 which effectively is a second longitudinally aligned aperture extending only partially through the primer.

FIG. 3 illustrates a second type of commercially available primer 20 wherein the cap well 26 has been dispensed with in favor of a second detonating cord tunnel 28 which is in parallel longitudinal alignment with the first detonating cord tunnel 24. As can be appreciated with reference to the embodiments of the primer 20 illustrated in both FIGS. 2 and 3, the exact positioning of the one or more detonating cord tunnels 24, 28 is variable, i.e., such tunnels being either coaxially aligned with a central longitudinal axis of the primer, as shown in FIG. 2, or being somewhat displaced radially therefrom, as shown in FIG. 3.

Figure 4:
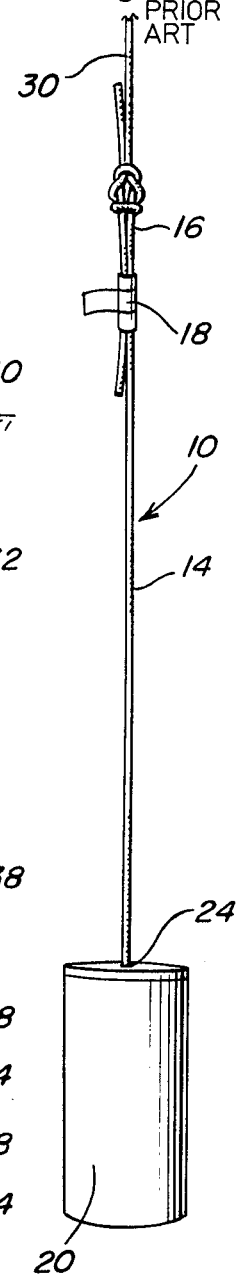
Fig. 4 PRIOR ART
FIG. 4 is a perspective view of a blasting cap and prior art primer operably attached to a detonating cord.

FIG. 4 provides a basic illustration of the manner of attachment of a delay cap 10 to a primer 20 and to a length of detonating cord 30. In this regard, it can be seen that the shock tube 14 associated with the delay cap 10 may be directed through the detonating cord tunnel 24 of the primer 20 so as to establish an operable connection therebetween. Further, the loop 16 of the delay cap 10 may then be attached to the length of detonating cord 30, such as by commercially available Primaline, typically by means of a double wrap square knot. As such, an igniting of the detonating cord 30 will result in a similar igniting of the fuse portion 14 which will then eventually ignite an unshown blast cap 12 and subsequently the primer 20.

Figure 5:
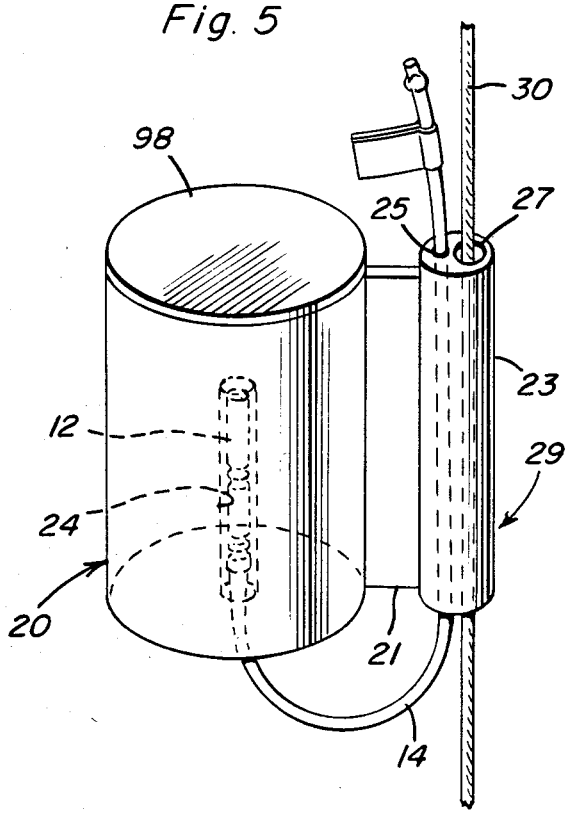
FIG. 5 is a perspective view of a sliding delay primer of the prior art.

FIG. 5 illustrates a sliding delay primer 20 having an extending web portion 21 and a tunnel member 23 which form an adapter 29. The adapter 29 is provided with a pair of through extending tunnels 25, 27 which respectively receive a shock tube 14 associated with a non-electric blasting cap 12 and a length of detonating cord 30. This prior art arrangement permits a primer to be slid down a length of detonating cord 30 to a desired location; however, the construction is not such as to permit the use of the shock tube 14 as a means of attaching the primer 20 to the adapter 29 per se.

Figure 6:
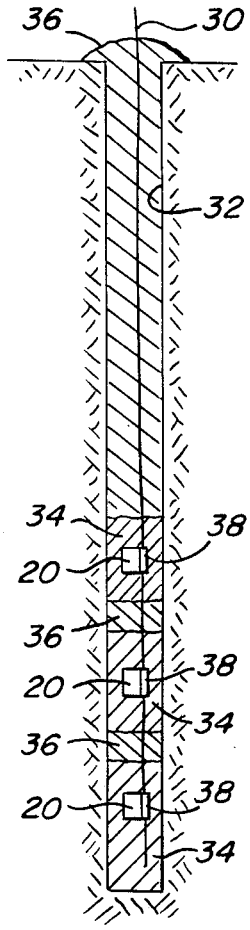
FIG. 6 is a schematic illustration of the manner of attaching a plurality of primers mounted from adapters of the present invention to a detonating cord in a blast hole.

FIG. 6 illustrates the manner of utilizing the present invention in conjunction with a plurality of explosive charges and primers 20, whereby the individual explosives are caused to ignite at definite time intervals, thereby to reduce the amount of noise, shock and other disturbances which might otherwise occur if all of the explosives were ignited concurrently. Specifically, it can be seen that a blast hole 32 may have a length of detonating cord 30 directed down therethrough, such detonating cord hereinafter being referred to as a downline, to which may be selectively attached at spaced intervals a plurality of primers 20. As shown, the bottommost primer 20 may be positioned within an explosive mixture 34, such as ANFO or slurry, and a first layer of stemming 36, which is effectively no more than an inert separation, may be provided. A second quantity of explosive 34 may then be provided around the second primer 20 with an even further layer of stemming 36 being provided thereabove, while the topmost primer 20 may be similarly surrounded by an explosive mixture. The remainder of the blasting hole may then be filled with additional stemming 36, and it can be appreciated that an igniting of the detonating cord 30 will result in the near simultaneous ignition of the shock tubes 14 associated with each of the respective primers 20, while the delay associated with each primer will be achieved by varying the type of delay cap attached to its respective shock tube.

As can be partially observed with reference to FIG. 6, each of the primers 20 may be provided with an adapter 38 which serves to operably connect the respective primers to the detonating cord 30. As will be subsequently described with reference to the further views of the drawings, the adapter 38, which essentially represents the various embodiments of the present invention, may be utilized to effect the desired interconnection between the individual primers 20 and the detonating cord 30, so that only one detonating cord need be utilized to actuate the predetermined time-delayed firing of the respective primers and associated explosive mixtures 34. In this respect, were the adapters 38 not to be used in combination with the three cast primers 20 illustrated in FIG. 6, it would be necessary to utilize three denotating cords 30, one each of which would be attached to a respective one of the primers.

Figure 7:
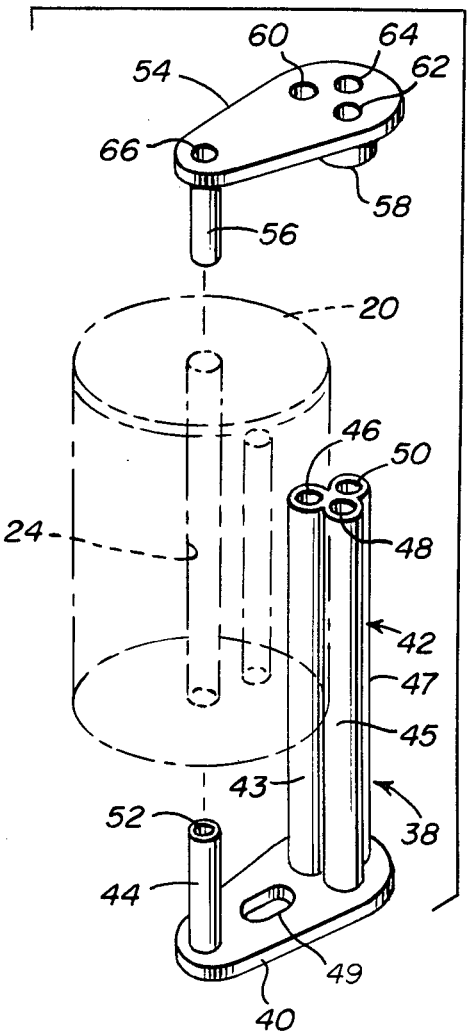
FIG. 7 is an exploded perspective view of a first embodiment of the adapter forming the present invention.

With reference now to FIG. 7 of the drawings, a first embodiment of the adapter 38 forming the present invention will be described. In this regard, it can be seen that the adapter 38 includes a bottom positioned bracket 40 with a plurality of cord tunnel members 42 being fixedly secured thereto. Further, an anchor tube 44 is connected to the bracket 40 for mating with tunnel 24 and an aperture 49 in the bracket 40 is provided to permit access to a cap well 26 associated with a primer 20. As illustrated, the anchor tube 44 and the cord tunnel members 42 may be an integral part of the bracket 40 or, alternatively, they may be separately made and fixedly secured thereto in any conventional manner.

As can be further ascertained with reference to FIG. 7, the cord tunnel members 42 essentially consist of three longitudinally aligned and integrally attached conduits 43, 45, 47 having respective through extending apertures 46, 48, 50, while the anchor tube 44 is also essentially a conduit with a through extending aperture 52.

By the same token, the adapter 38 further includes a top bracket 54 which is of a shape similar to the bracket 40 and which includes a further anchor tube 56, as well as a cord tunnel receiving member 58. In this connection, the cord tunnel receiving member 58 is of a shape and design which permits a snap or other type of fit to be achieved between the bracket 54 and a top portion of the cord tunnel members 42. Further, the bracket 54 is provided with three through extending apertures 60, 62, 64 which are respectively coaxially aligned with the apertures 46, 48, 50, thereby to establish the continuity of the apertures completely through the adapter 38, while the anchor tube 56 is also provided with a through extending aperture 66 for mating with tunnel 24. Inasmuch as FIG. 7 illustrates the adapter 38 in an exploded and disassembled form, it can be appreciated that this exploded representation illustrates the desired manner of assembly of this particular embodiment of the invention to a primer 20. Once assembled, it can be further appreciated that the anchor tube 44 will be positioned within the tunnel 24, as will the anchor tube 56, while the cord tunnel members 42 will be positioned in longitudinal alignment with and exteriorly of the primer 20. Additionally, the cord tunnel members 42 will be snap fitted or otherwise fixedly secured to the cord tunnel receiving member 58 associated with the bracket 54, and the aperture 49 contained in the bracket 40 will be aligned with the cap well 26.

Figure 8:
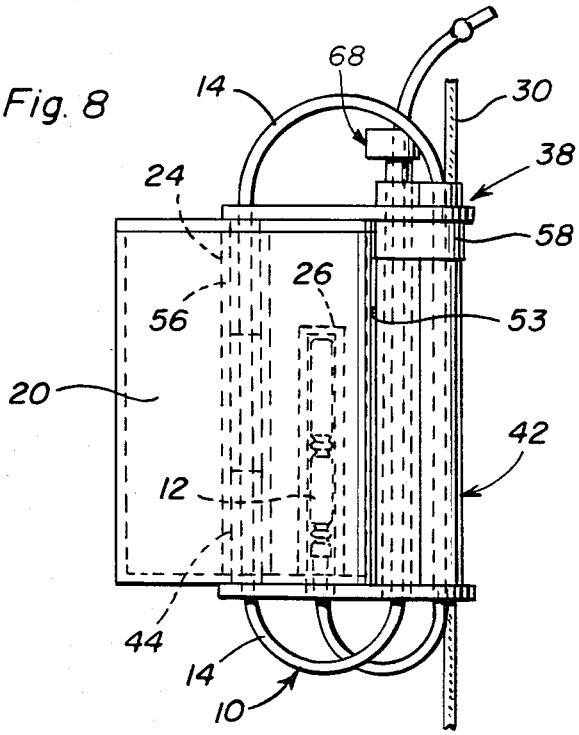
FIG. 8 is a side elevational view of the adapter of FIG. 7 operably attached to a primer and delay blasting cap.

The assembled arrangement of the adapter 38 with the primer 20 can be better understood by reference to FIG. 8 of the drawings. Specifically, it can be seen that when the cord tunnel members 42 are fixedly secured to the cord tunnel receiving member 58, both of the anchor tubes 44, 56 will be positioned within the tunnel 24, thereby to securely position the adapter 38 in engagement with the primer 20. Further, it can be seen that a delay cap 10 may be operably attached to the primer 20 and adapter 38 through a positioning of the blasting cap 12 within the cap well 26 and a subsequent looping or directing of the shock tube 14 at least once through one or more of the apertures 46, 48, 50. Typically, it is expected that the shock tube 14 will normally be directed through at least one of the apertures 46, 48, 50, while the detonating cord 30 will be normally directed downwardly through the same aperture as the shock tube 14 such as aperture 50. As can be appreciated, depending upon the diameter of the detonating cord 30, a portion of the shock tube 14 may be directed through the same apertures, such as aperture 50, in an abutting relationship with the detonating cord 30 or, alternatively, the shock tube may be directed through apertures 46, 48 with the detonating cord in aperture 50. Further shown is an isolation space 53 between the primer 20 and the cord tunnel members 42 which serves to prevent a premature detonation of the primer while the detonating cord 30 and the shock tube 14 are burning.

Also illustrated in FIG. 8 is the use of a tube lock 68 which is selectively positioned about a portion of the shock tube 14 and insertable within one of the apertures 46, 48, 50 so as to effect a retention of the shock tube in position. In this respect, reference is made to FIGS. 9 and 10 of the drawings, wherein it can be seen that the tube lock 68 is generally of a cylindrical construction including a cylindrical body portion 70, a longitudinally aligned extension 72 and a longitudinally extending slot 74 which passes in common relation through both the extension 72 and the body portion 70. As shown, the slot 74 is basically of a wedge shape configuration having an inner partly cylindrical opening 75 which extends through the body portion 70 and the extension 72 to receive and retain the shock tube 14 once the same has been force fitted into the slot 74. In this respect, the tube lock 68 is of a resilient construction such as of elastomeric material so as to permit a tight frictional fit to be achieved about the Nonel shock tube 14 after the tube is in position. Alternatively, an overhand knot might be provided in the shock tube 14 in lieu of the tube lock 68.

Inasmuch as a first embodiment of the present invention has now been described, a second embodiment will be discussed with reference to FIG. 11 of the drawings. In this respect, a modified blasting cap to primer adapter 76 is illustrated which utilizes a plurality of cord tunnel members 42, to include apertures 46, 48, 50 as in the first embodiment, and further including an arcuately shaped attachment member 78 integrally molded thereto for matingly engaging primer 20. In this regard, the entire construction of the adapter 76 can be achieved by injection molding, thereby to present the adapter in an integral form ready for attachment to the primer 20.

Figure 13:
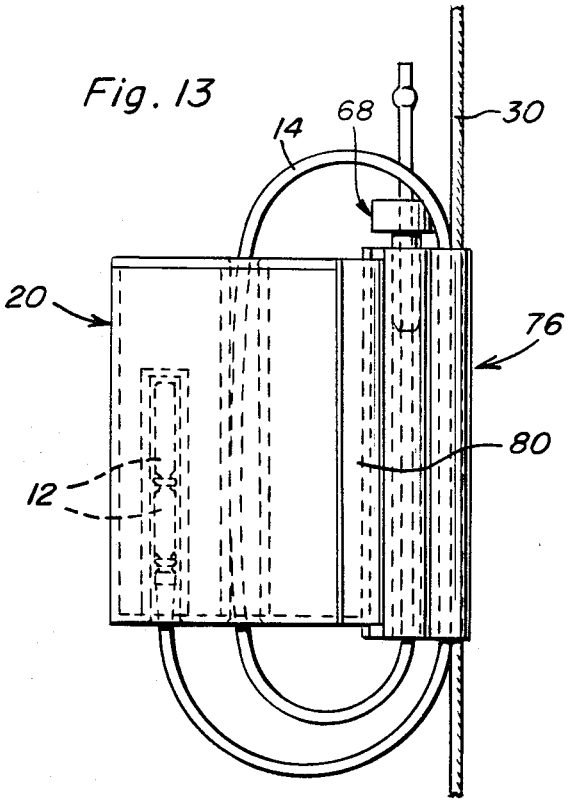
FIG. 13 is a side elevational view of the second embodiment of the adapter operably attached to a primer.
Figure 12:
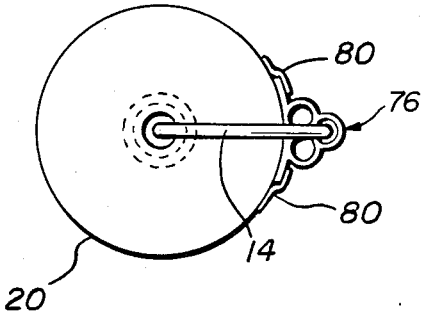
FIG. 12 is a top plan view illustrating the second embodiment of the adapter operably attached to a primer.

As to the manner of attaching the adapter 76 to the primer 20, reference is made to FIGS. 12 and 13 wherein it can be seen that tape 80 is conveniently employed to effect the desired attachment of the adapter to the primer. Of course, it is to be understood that any conventional manner of attachment of the adapter might be employed, to include glue, banding wire, etc., or just by the threading of the shock tube 14 through the adapter itself, which in this respect is the preferred form of attachment.

Figure 14:
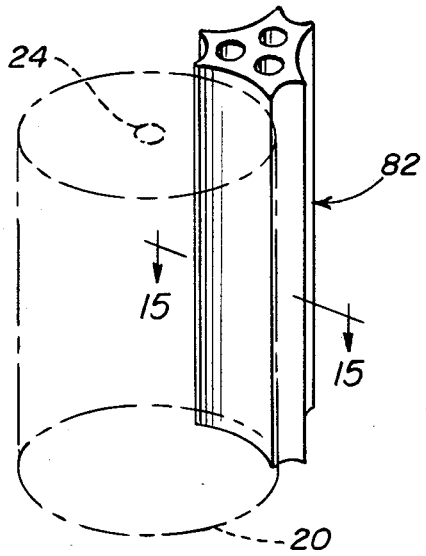
FIG. 14 is a perspective view of a third embodiment of the adapter forming the present invention.
Figure 15:
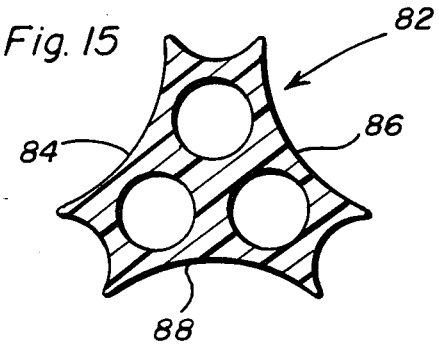
FIG. 15 is a sectional view of the third embodiment of the adapter taken along the line 15—15 of FIG. 14.

FIG. 14 shows a further embodiment of the invention in the form of adapter 82 which is of such a shape and design as to permit a construction thereof by extrusion molding. In this respect, reference is made also to FIG. 15 in conjunction with FIG. 14 wherein it can be seen that the adapter 82 is of a symmetrical design and includes three arcurately shaped surfaces 84, 86, 88, any one or more of which may be brought into abutment with an outer circumferential surface of a primer 20 only one of which is shown in FIG. 14, thereby to effect the desired attachment between the adapter 82 and the primer. It should be further noted with reference to FIG. 14 that the length of the adapter 82 need not be substantially the same as the height of the primer 20. To the contrary, it has been found that the adapter 82, as well as the adapter 76 illustrated in FIG. 11, can be of a substantially shorter length than the height of the primer 20 without materially affecting the efficiency thereof. Additionally, the adapter 82 may be attached to the primer 20 by any conventional and well known manner with the shock tube 14 threaded through the adapter being the preferred form of attachment and which may as desired communicate with and be in contact with the detonation cord 30.

Figure 16:
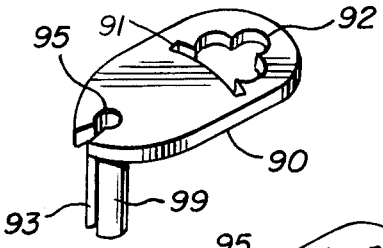
FIG. 16 is a perspective view of a second embodiment of the bracket utilized in the embodiment of the adapter shown in FIG. 7.
Figure 17:
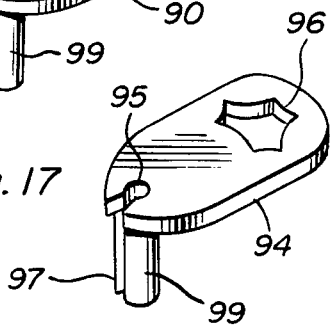
FIG. 17 is a perspective view of a third embodiment of the bracket utilized in the embodiment of the adapter shown in FIG. 7.

FIGS. 16 and 17 illustrate further modifications of the present invention wherein either of the adapters 38, 76 or 82 may be attached to the primer 20. Specifically, FIG. 16 illustrates a modified bracket 90 which may be used in place of the bracket 54 on adapter 38, such bracket having a cutout 92 which substantially conforms to the shape of the cord tunnel member 42. Of course, it is to be understood that a bottom bracket similar to the bracket 40 could be used in lieu of bracket 40. Accordingly, the adapter could then be assembled in the above-described manner by utilizing brackets 90 engaged with the adapter 76 or 82 in place of the cord tunnel members 42. Also to be noted with reference to FIG. 16 is the use of a modified wedge-shaped cutout 93 having opening 95 in lieu of a through extending aperture 66 or 52 as shown in FIG. 7 to enable lateral assembly of shock cord 14. The modified wedged-shaped cutout 93 may further be provided with a cylindrically-shaped bottom portion 99 to facilitate a gripping of an appropriately positioned shock tube 14 (not shown) therein. The cutout 92 includes lateral extensions 91 at the inner ends thereof which enables brackets 90 to engage and receive the ends of the adapter 76.

By the same token, FIG. 17 illustrates a bracket 94 which could be utilized in conjunction with the adapter 82, such bracket having a cutout 96 which substantially conforms to the shape of the adapter 82. Two brackets 94 are used so that the adapter 82 could be assembled with the primer 20. Similarly, the bracket 94 is provided with a wedged-shaped cutout 97 having a cylindrically-shaped bottom portion 99 with an opening 95 so as to effect a desired retention of a Nonel shock tube 14 (not shown) in the manner of bracket 90 shown in FIG. 16.

Figure 18:
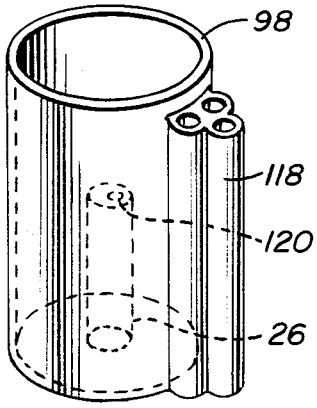
FIG. 18 is a perspective view of a further embodiment of the present invention wherein the primer and adapter are of an integral molded construction.
Figure 19:
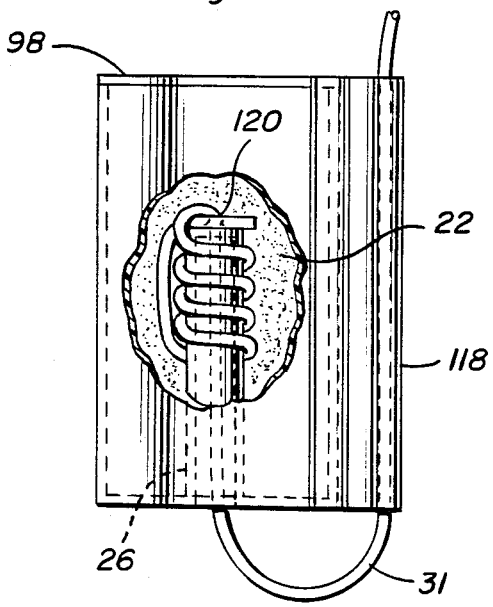
FIG. 19 is an elevation view, partly in section, of the adapter of FIG. 18 with a further embodiment of the present invention wherein only detonating cord is utilized to detonate the primer.

FIGS. 18 and 19 illustrate another modified version of the present invention, whereby the same may be integrally formed during a manufacturing process to include a hollow shell housing 98 forming a primer with an adapter 118 fixedly secured thereto. This embodiment is also illustrative of the fact that the adapter 118 may be of a shorter construction than the height of the primer without materially affecting the efficiency and reliability thereof. FIGS. 18 and 19 also illustrate the fact that the shell housing 98 may be modified to eliminate the cord tunnels 24, 28 and utilize only a cap well 26. In this connection, the cap well 26 may be further provided with an aperture 120 which establishes a communication between the interior of the housing 98 and the interior portion of the cap well 26. This construction then permits a modified use of the invention wherein a short piece of detonating cord 31 may be pre-assembled in the primer 20. Specifically, the piece of detonating cord 31 may be directed downwardly through one of the apertures contained in the adapter 118 and may then be positioned upwardly through the aperture 120 contained in the cap well 26, such aperture then being appropriately sealed. The piece of detonating cord 31 may then be wrapped around the outer surface of the cap well 26 as contained within the housing 98 in the manner illustrated, so as to effectively secure the same therein, and the housing 98 may then be filled with explosive material 22. In effect, direct contact is established between the piece of detonating cord 31 and the explosive 22.

Figure 20:
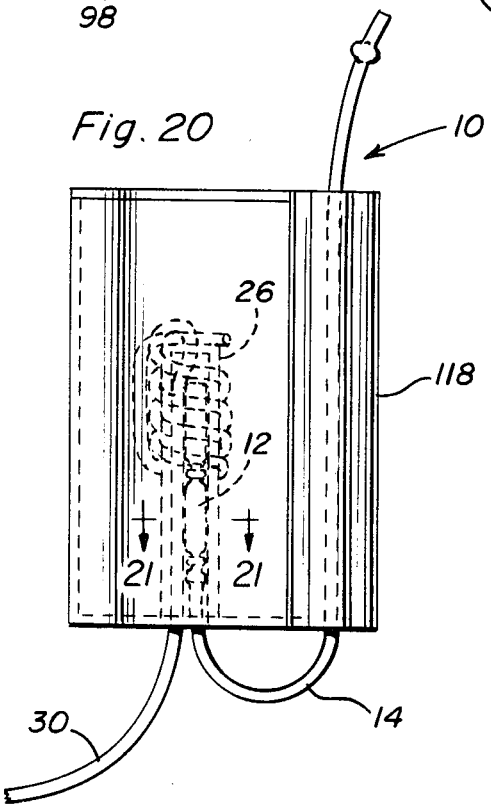
FIG. 20 is a side elevational view of a modified form of the embodiment of FIG. 19 wherein a blasting cap and detonating cord are utilized in combination within the primer.
Figure 21:
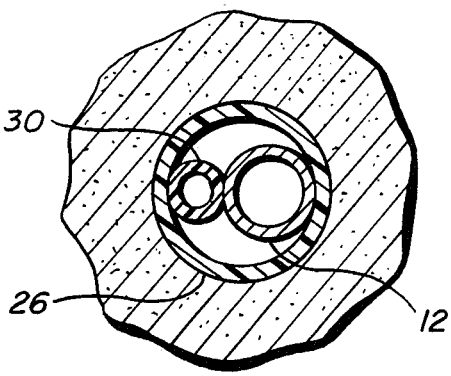
FIG. 21 is a sectional view illustrating the manner of positioning a blasting cap and detonating cord within a cap well and taken along the line 21—21 of FIG. 20.

Alternatively, a delay cap 10 arrangement may be employed, as illustrated in FIGS. 20 and 21, whereby a blasting cap 12 may be positioned within the cap well 26 in a direct abutting relationship with the detonating cord 30. If desired, the shock tube 14 may then be directed upwardly through one or more of the apertures contained in the adapter 118, while the detonating cord 30 would not be directed through the apertures.

Figure 22:
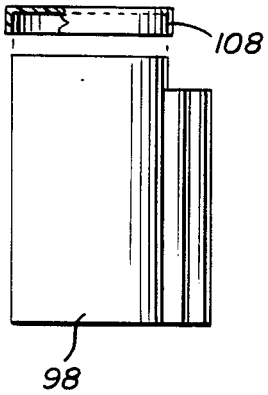
FIG. 22 is an exploded view of a first form of removable cap associated with the primer of FIG. 18.
Figure 23:
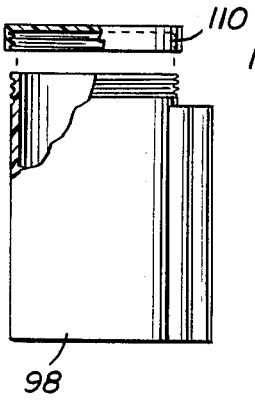
FIG. 23 is an exploded view of another form of primer cap as utilized in the embodiment of FIG. 18.
Figure 24:
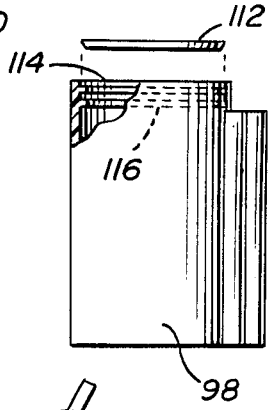
FIG. 24 is an exploded view of yet another form of primer cap operably associated with the embodiment of FIG. 18.

Inasmuch as the shell housing 98 may be used in place of the normal primer 20 housing, some means of access into the shell housing must be provided so as to fill the same with an explosive. This access may be accomplished by various means, such as those illustrated in FIGS. 22–24. Specifically, FIGS. 22–24 respectively illustrate the uses of lids 108, 110, 112 which may be employed to permit access into an interior of the shell housing 98. As shown, lid 108 may be of a snap-fit construction mountable over an outer circumferential exterior surface of the housing, thereby to achieve the desired access into the interior of the housing. By the same token, a threaded construction might be employed, as illustrated in FIG. 23, wherein the lid 110 is provided with a plurality of internal helical threads and the housing 98 is provided with external threads whereby a threaded engagement between the lid and the housing can be achieved. Finally, an interior snap-fit construction may be employed, as illustrated in FIG. 24, wherein a pair of circumferentially extending, interiorly located ridges 114, 116, may be employed, with the lid 112 being designed to be snap-fitted into engagement between the ridges to achieve the desired closure of the housing.

FIGS. 25–27 have been provided to illustrate a preferred means of threading the shock tube 14 associated with a blasting cap 12 through a primer 20 and associated adapter 38. In this respect, the preferred method of threading illustrated in FIGS. 25–27 can be employed in combination with any of the adapters 38, 76, 82, 118 as above disclosed. As shown, it can be seen that the cap 12 may be positioned within a cap well 26 and the shock tube 14 may then be directed upwardly through the cord tunnel 24 for effecting a preheating condition on the primer 20 and then tube 14 passes downwardly through the aperture 46. The exiting portion of the shock tube 14 from the aperture 46 may then be directed through the loop 120 also for the same purposes as illustrated and then may be redirected upwardly through the aperture 48 to complete the preferred method of threading the blasting cap 10 to the primer 20. As can be appreciated, this preferred method of threading eliminates any need for utilizing alternative methods of attaching the various adapters to a primer 20, as well as insuring the eventual detonation of the primer in response to an ignition of the shock tube 14. In this respect the detonation cord 30 and the shock tube 14 conveniently may pass through a common tube for achieving heat transfer coupling as may be desired.

FIG. 28 illustrates some additional features of the present invention which might be employed to increase the reliability and efficiency thereof. In this respect, it can be seen, if desired, a length of shock tube 14 may be threaded downwardly through the aperture 48 and thence back upwardly through the aperture 46. In this respect, due to variations in manfacturing standards for the products involved, it may be necessary or advisable to use a short piece of booster cord 122 of the same or different grain size in apertures 46 and 48 to insure initiation of the shock tube 14 in all cases. Specifically, the successful initiation of any Nonel Primadet is possible by either the direct association of an appropriate available cord or by a variety of combinations of available cords, with there being no specific method of combining cords and tubes that need to be followed. In this connection, the decision of the method to be used can be selected by the user at the time of use based only on the cords available, with the only consideration being that the down line cord will permit the primer 20 to slide freely and also that the down line cord is sized so as to initiate the shock tube 14 associated with it or the cord which is in sliding contact with it, the latter being of such a size that it will initiate the tube to which it is in fixed abutment.

Lastly illustrated in FIG. 28 is the fact that various size apertures may be utilized in the adapter 118, or in any of the other adapters 38, 76, 82 disclosed in this application. Specifically, it can be seen that the apertures 46, 48 are shown as being of an equal diameter, with such diameter being sufficient to retain at least a length of Nonel shock tube 14 directed therethrough and, if desired, a length of booster cord 122 which could be of any selected grain size and associated diameter. By the same token, the down line cord 30 is shown as having a much greater diameter and accordingly, the tunnel 124 is of a greater diameter than either of the apertures 46, 48 thereby to accommodate the size of the down line cord 30 and the shock tube 14 together. In this regard, it is recognized that any combination of various sized cord apertures 46, 48 and 50 could be employed in the instant invention, depending on the intended uses thereof.

Figure 9:
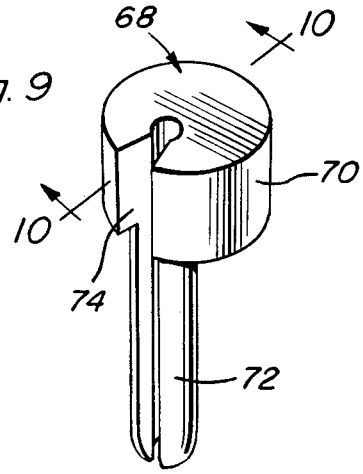
FIG. 9 is a perspective view of a tube lock forming a part of the present invention.
Figure 10:
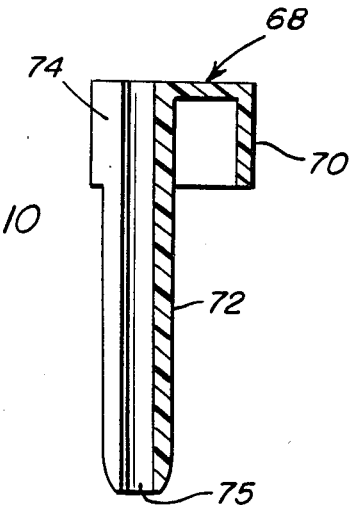
FIG. 10 is a longitudinal sectional view of the tube lock taken along the line 10—10 of FIG. 9.

In use, it can be appreciated that a user may conveniently attach any non-electric delay blasting cap 10 to any type of primer 20 through the use of the several embodiments of the present invention. For example, and with reference to FIG. 8 of the drawings, it can be seen that the adapter 38 may be employed to join a primer 20 to a detonating cord 30 and a non-electric delay cap 10. This is achieved by positioning the anchor tube 44 within the detonating cord tunnel 24 of the primer 20 in the manner illustrated and then attaching the bracket 54 to the topmost portion of the cord tunnel members 42 while directing the anchor tube 56 down into the remaining open end of the detonating cord tunnel 24. As shown, the cord tunnel members 42 are attached to the bracket 54 through an engagement with the cord tunnel receiving member 58, and a delay cap 10 may then have its blasting cap 12 directed downwardly through one of the apertures 46, 48 until the blasting cap has passed completely through the selected aperture. Inasmuch as the aperture 49 is in alignment with the cap well 26 of the primer 20, the blasting cap 12 may then be directed upwardly through the aperture 49 and into the cap well 26. Alternatively, a substantial portion of the Nonel shock tube 14 may be pulled through the selected aperture and then looped through an adjacent aperture. The blasting cap may then be inserted into the cap well 26 in the aforementioned manner. If desired, a tube lock 68, as illustrated in FIGS. 8–10 may be employed to secure the shock tube 14 in position. This is achieved by snap fitting a portion of the shock tube 14 within the slot 74 associated with the tube lock 68, and then sliding the tube lock downwardly until its extension 72 comes into frictional engagement with a top portion of the selected aperture 46, 48. The entire assembly may then be slid down a length of detonating cord 30 which is directed upwardly through the outside remaining aperture 50, whereby an arrangement as illustrated in FIG. 8 is achieved.

As shown in FIG. 6, a blast hole 32 may utilize a plurality of these primers 20 and adapters 38 on a downline, each being separated by inert separations 36, commonly referred to in the industry as stemming, so that a desired delay between respective explosions can be obtained. Specifically, upon ignition of the detonating cord 30, the same will cause a similar ignition of the shock tube 14, which, of course, burns at a much slower rate, thereby to eventually ignite the blasting cap 12 and primer 20. The explosion of the primer 20 results in a concurrent explosion of the ANFO or slurry employed in the blast hole 32. Inasmuch as a space 53 is provided as shown in FIG. 8 between the cord tunnel members 42 and the cast primer 20, an undesired destruction of the primer during a burning of the cord 30 is prevented.

Figure 11:
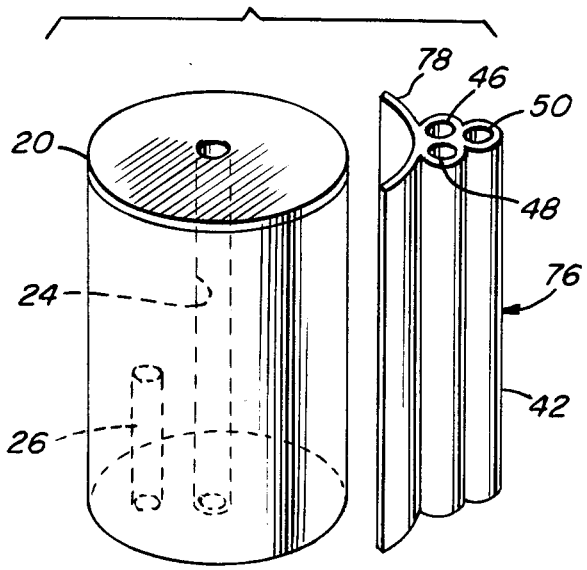
PRIOR ART Fig. 11
FIG. 11 is an exploded perspective view illustrating the manner of attachment of a second embodiment of the adapter forming the present invention to a primer.

In the event that a user wishes to employ the adapter 76, as shown in FIG. 11, or the adapter 82, as shown in FIG. 14, the same procedure may be followed, with these respective adapters being retained in place either completely or partially by the interlooping of the shock tube 14 through the apertures contained in the adapters and the primer 20, with further securement being achieved through the use of tape 80, as shown in FIG. 12, if desired. As to the embodiment of the invention illustrated in FIGS. 19–21, it is to be understood that the adapters 38, 76, 82 need not be employed since a piece of detonating cord 30 is integrally constructed as a pigtail in conjunction with the primer 20. If used, a blasting cap 12 having a delay lead shock tube 14 may be wedged within the illustrated cap well 26 in a close abutting relationship with the detonating cord 30. This configuration is achieved, of course, by constructing the cap well 26 of a desired diameter which will effect the desired frictional fit between the blasting cap 12 and the detonating cord 30. If desired, the shape of the cap well 26, as illustrated in FIG. 21, could be changed to resemble a "figure eight" construction thereby to further facilitate the frictional grip between the blasting cap 12 and the pigtail of detonating cord 30 contained therein.

With respect to the above description, it should be realized that the optimum dimensional relationships for the parts of the invention are deemed readily apparent and obvious to one skilled in the art to which the invention pertains, and all equivalent relationships to those illustrated in the drawings and described in the specification, to include modification of form, size, arrangement of parts and details of operation, are intended to be encompassed by the present invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adapter for operably associating any of a plurality of different types of detonating means to any of a plurality of different types of primers comprising:

tunnel means through which a detonating cord forming a downline passes for coupling to a detonating means in a primer at any point along the length of the downline and means for attaching the tunnel means onto the primer with the downline spaced from the primer to prevent direct detonation of the primer by the downline, said tunnel means and said attaching means including at least two arcuately shaped surfaces, any one of which may be brought into an abutting relationship with an outer circumferential surface of said primer, thereby to facilitate a connection of said attaching means and said tunnel means to said primer.

2. For use in combination with a primer for an explosive charge and a downline detonating cord positioned in a borehole, an adapter body having an aperture receiving the downline detonating cord and positioned on the downline at any point along the length thereof, said primer including a detonating means located in the central portion thereof with said detonating means including a detonating force transmitting means connected thereto and associated with the downline detonating cord at any point along the length thereof, said body including an additional aperture therein receiving the detonating force transmitting means in operative association with the downline detonating cord, said body being fixedly associated with the primer to maintain the downline detonating cord receiving aperture remote from the primer to prevent direct detonation of the primer from the downline detonating cord and assuring detonation of the primer from the central portion thereof by the detonating means therein, said body including three apertures arranged in a triangular pattern thereby assuring that one of the apertures is remote from the primer.

3. The structure as defined in claim 2 wherein the periphery of said body includes three equally spaced concave recesses with each recess having a pair of apertures adjacent thereto and the third aperture remote therefrom, said recesses being configured to fittingly engage a portion of the periphery of the primer thereby assuring that one of the apertures is remote from the primer regardless of which recess engages the primer.

* * * * *